United States Patent [19]

Kudo et al.

[11] Patent Number: 4,928,569

[45] Date of Patent: May 29, 1990

[54] ENVELOPE SHAPE GENERATOR FOR TONE SIGNAL CONTROL

[75] Inventors: Masaki Kudo; Hideo Suzuki, both of Hamamatsu, Japan

[73] Assignee: Yamaha Corporation, Hamamatsu, Japan

[21] Appl. No.: 120,071

[22] Filed: Nov. 13, 1987

[30] Foreign Application Priority Data

Nov. 15, 1986 [JP] Japan ..... 61-272672
Nov. 15, 1986 [JP] Japan ..... 61-272673

[51] Int. Cl.[5] ..... G10H 7/00; G10H 1/02; G10H 5/00

[52] U.S. Cl. ..... 84/626; 84/627; 84/633; 84/663; 84/665; 84/702; 84/703

[58] Field of Search ..... 84/1.13, 1.26, 1.27, 84/626, 627, 633, 662, 663, 665, 701, 702, 703, 711

[56] References Cited

U.S. PATENT DOCUMENTS

| | | | |
|---|---|---|---|
| 4,079,650 | 3/1978 | Deutsch et al. | 84/1.26 |
| 4,178,826 | 12/1979 | Hiyoshi et al. | 84/1.26 |
| 4,267,763 | 5/1981 | Futamase et al. | 84/1.22 |
| 4,357,849 | 11/1982 | Ezawa et al. | 84/1.26 X |
| 4,422,363 | 12/1983 | Deforeit | 84/1.13 X |
| 4,763,257 | 8/1988 | Clynes | 84/626 X |

FOREIGN PATENT DOCUMENTS

| | | |
|---|---|---|
| 55-07600 | 2/1980 | Japan . |
| 58-65489 | 4/1983 | Japan . |

*Primary Examiner*—A. T. Grimley
*Assistant Examiner*—Matthew S. Smith
*Attorney, Agent, or Firm*—Spensley Horn Jubas & Lubitz

[57] ABSTRACT

An envelope shape generator generates envelope shape data for controlling a tone signal in the form of data in decibel representation. In performing a rapid attenuation control called "forcing damp" during attenuation of the envelope shape data generated by the envelope shape generator, the envelope shape data in decibel representation is rapidly attenuated with such a characteristic that inclination of attenuation becomes increasingly steeper. This is advantageous because inclination of a rapidly attenuating portion is modified to a substantially uniform inclination when the envelope shape data is converted to data in linear representation. There are also provided a detection circuit for detecting that the level of the envelope shape has dropped below a predetermined level corresponding to a minimum level at which a tone waveshape can be effectively represented and a circuit for rapidly attenuating the envelope shape in response to this detection. This contributes to elimination of noise.

25 Claims, 9 Drawing Sheets

ENVELOPE SHAPE GENERATOR 10

ENVELOPE SHAPE GENERATOR 10

ENVELOPE CONTROL DEVICE 60

SHIFT DATA SUPPLY CIRCUIT 620

ENVELOPE SHAPE GENERATOR FOR TONE SIGNAL CONTROL

BACKGROUND OF THE INVENTION

This invention relates to an envelope shape generator for tone signal control and, more particularly, to an improvement in a control for rapidly attenuating a generated envelope shape called "forcing damp". This invention relates also to an envelope shape generator capable of attenuating an envelope shape signal rapidly for restraining noise which is generated in a tone signal controlled by this envelope shape signal when the level of the envelope shape signal has decreased during attenuation.

An envelope shape for tone signal control generally consists of characteristics called A (attack), D (decay), S (sustain) and R (release). Among these characteristics, the release characteristic is one in which the level attenuates relatively gradually from a sustain level to zero level. Inclination of attenuation in this release characteristic generally becomes increasingly gradual with a lapse of time. This is a simulation of general attenuating characteristic of a natural musical tone and a tone being sounded is muted in a natural manner.

It is also known in the art to attenuate an envelope shape rapidly by making inclination of attenuation steeper from a certain point in the release. This is a control called "damp" or "forcing damp" which is performed by intentional operation of a damper operator or in a case where a tone which is being sounded needs to be muted rapidly for sounding of a new tone.

It is known to generate an envelope shape signal for tone signal control in the form of data in decibel representation (e.g., Japanese Patent Publication No. 7600/1980 and U.S.P. 4,267,763). This art is employed because it has the advantages that multiplication of data in linear representation can be replaced by a simple addition in data of decibel representation and that, if envelope shape data in decibel representation is converted to data in linear representation, its attenuating portion attenuates with an exponential function characteristic and this is acoustically desirable. If, however, an envelope shape in decibel representation as shown in FIG. 12*a* is converted to data in linear representation in this case, the characteristic of the converted data becomes as shown in FIG. 12*b* in which the attack portion lacks steepness in rising. Efforts have therefore been made in the art to ensure steepness in rising in the attack portion as shown in FIG. 12*c*.

The above mentioned "forcing damp" is disclosed in, for example, Japanese Preliminary Patent Publication 65489/1983. In performing forcing damp in generating an envelope shape data in decibel representation, the forcing damp portion in the prior art has the same uniform inclination characteristic as other attenuating portions though the inclination is steeper in the forcing damp portion than in the other portions (see FIG. 13*a*).

In performing forcing damp, there is requirement, on one hand, that the envelope shape should be attenuated as rapidly as possible (in other words, a preceding tone should be erased as rapidly as possible) and also there is requirement, on the other hand, that excessively rapid attenuation causes a click noise so that the envelope shape should be attenuated with an inclination which will not cause such click noise. As described above, if an envelope shape in decibel representation as shown in FIG. 13*a* is converted to data in linear representation, it exhibits an exponential function characteristic as shown in FIG. 13*b*. That is, the forcing damp portion attenuates with the exponential function characteristic as in a normal attenuating portion. For this reason, the inclination of the envelope shape is excessively steep at the beginning of forcing damp and becomes gradual towards the end of forcing damp. The excessively steep inclination at the beginning of forcing damp causes a click noise as described above. The inclination of the forcing damp portion in decibel representation therefore is restricted with a result that a period T of forcing damp tends to become unnecesarily long. Besides, since the forcing damp portion attenuates with an exponential function characteristic in the converted data in linear representation (FIG. 13*b*), it takes unnecessarily long time before the tone is extinguished completely with a result that starting of a next tone is delayed.

The known damp control is performed compulsorily regardless of the level of the envelope shape at that time only when necessity has arisen due to external factors such as operation of a damper operator and depression of a new key. If such necessity does not arise, the envelope shape attenuates in accordance with a normal release characteristic.

Since a digital tone waveshape signal generally is a quantized signal, a certain number of bits is necessary for each sampled value for effectively representing the tone waveshape. If, however, the amplitude of the digital tone waveshape signal is controlled in response to the envelope shape signal, the amplitude of the digital tone waveshape signal becomes small as the level of this envelope shape signal becomes small with a result that the bit number for representing each sampled value of this tone waveshape signal becomes small. Schematically illustrated, if the level of the envelope shape signal is relatively large and accordingly the amplitude of the digital tone waveshape signal is relatively large, the tone waveshape can be effectively represented as shown in FIG. 15*a* and S/N ratio is good in this case. If, however, the level of the envelope shape signal is small and accordingly the amplitude of the digital tone waveshape signal is smaller than a bit number capable of effectively representing the tone waveshape, the tone waveshape cannot be effectively represented as shown in FIG. 15*b* and, in this case, S/N ratio is deteriorated and a hissing noise occurs.

SUMMARY OF THE INVENTION

It is, therefore, an object of the invention to provide an envelope shape generator which, in generating an envelope shape in decibel representation, is capable of completing the rapidly attenuating portion in a short period of time without causing a click noise.

It is another object of the invention to provide an envelope shape generator comprising an envelope control device capable of controlling an envelope shape signal used for tone control for restraining a noise occurring in a tone signal controlled by the envelope shape signal when the level of the envelope shape signal has decreased during its attenuation.

The envelope shape generator achieving the first described object of the invention comprises envelope shape forming means for forming an envelope shape for controlling a tone signal in the form of data in decibel representation and rapid attenuation means for rapidly attenuating the envelope shape in decibel representation with such a characteristic that inclination of attenuation becomes increasingly steep when the envelope shape should be rapidly attenuated.

When the envelope shape is to be attenuated rapidly (e.g., when a forcing damp command has been issued), the envelope shape data in decibel representation formed by the envelope shape forming means is rapidly attenuated so that the inclination of attenuation becomes increasingly steep. This is illustrated as shown in FIG. 14*a*. At the beginning of the rapid attenuation, the inclination is most gradual and becomes increasingly steep thereafter.

Since the envelope shape data in decibel representation in the rapidly attenuating portion is one as described above, the characteristic of data in linear representation after conversion becomes one as shown in FIG. 14*b*. As will be apparent from comparison of this data with the data shown in FIG. 13*b*, the inclination at the beginning of the rapidly attenuating portion may be of the same order according to which no click noise will be produced both in FIG. 14*b* and FIG. 13*b* but in FIG. 14*b*, this inclination continues substantially to the end whereas in FIG. 13*b*, the inclination becomes increasingly more gradual (for facilitating comparison, the inclination of FIG. 13*b* is also shown by a dotted line in FIG. 14*b*). Accordingly, period T' of the rapidly attenuating portion according to the present invention can be shortened as compared to the period T of the rapidly attenuating portion according to the prior art envelope shape generator.

The envelope shape generator achieving the other object of the invention comprises detection means for detecting that the level of an envelope shape signal for controlling a tone signal has dropped below a predetermined level corresponding to a minimum level at which a tone waveshape can be effectively represented and rapid attenuation control means for rapidly attenuating the envelope shape signal in response to the detection by said detection means during attenuation of the envelope shape signal.

When the level of the envelope shape signal has dropped below the predetermined level corresponding to the minimum level at which the tone signal can be effectively represented, the detection means detects this state. If the detection by this detection means has been made during attenuation of the envelope shape signal, the rapid attenuation control means attenuates the envelope shape signal rapidly in response to this detection. This is illustrated by an envelope shape diagram of FIG. 16. In this figure, when the level of the envelope shape signal during attenuation has dropped below a predetermined level ML, rate of attenuation is changed so that the envelope shape signal attenuates rapidly. By this arrangement, a portion in the envelope shape signal whose level is so small that a tone waveshape cannot be effectively represented attenuates rapidly and a tone corresponding to this portion is rapidly muted and, as a result, an unpleasant noise can be restrained.

BRIEF DESCRIPTION OF THE DRAWINGS

In the accompanying drawings.

DESCRIPTION OF PREFERRED EMBODIMENTS

Figure 1:
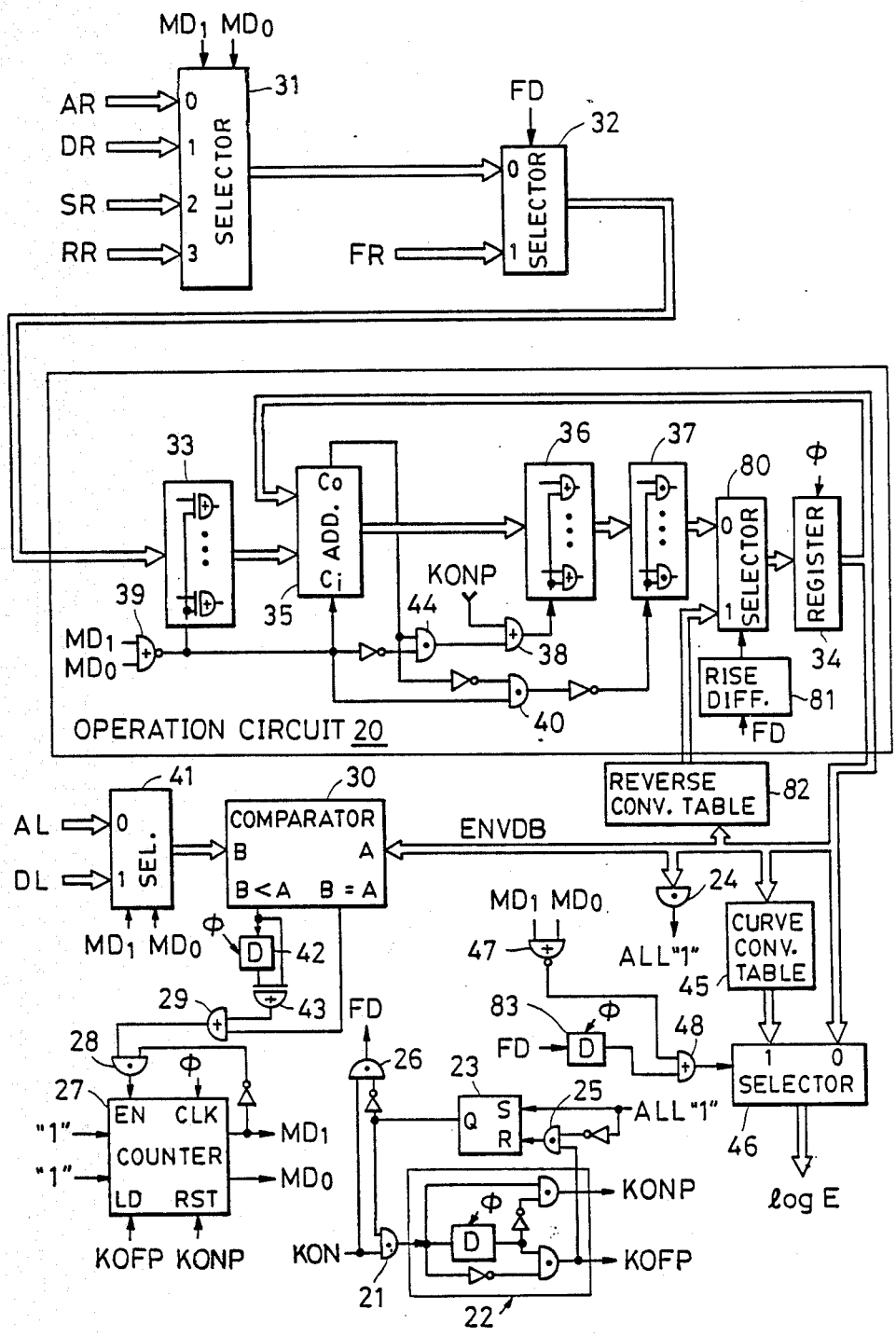
FIG. 1 is a block diagram showing an embodiment of the envelope shape generator according to the invention.
Figure 2:
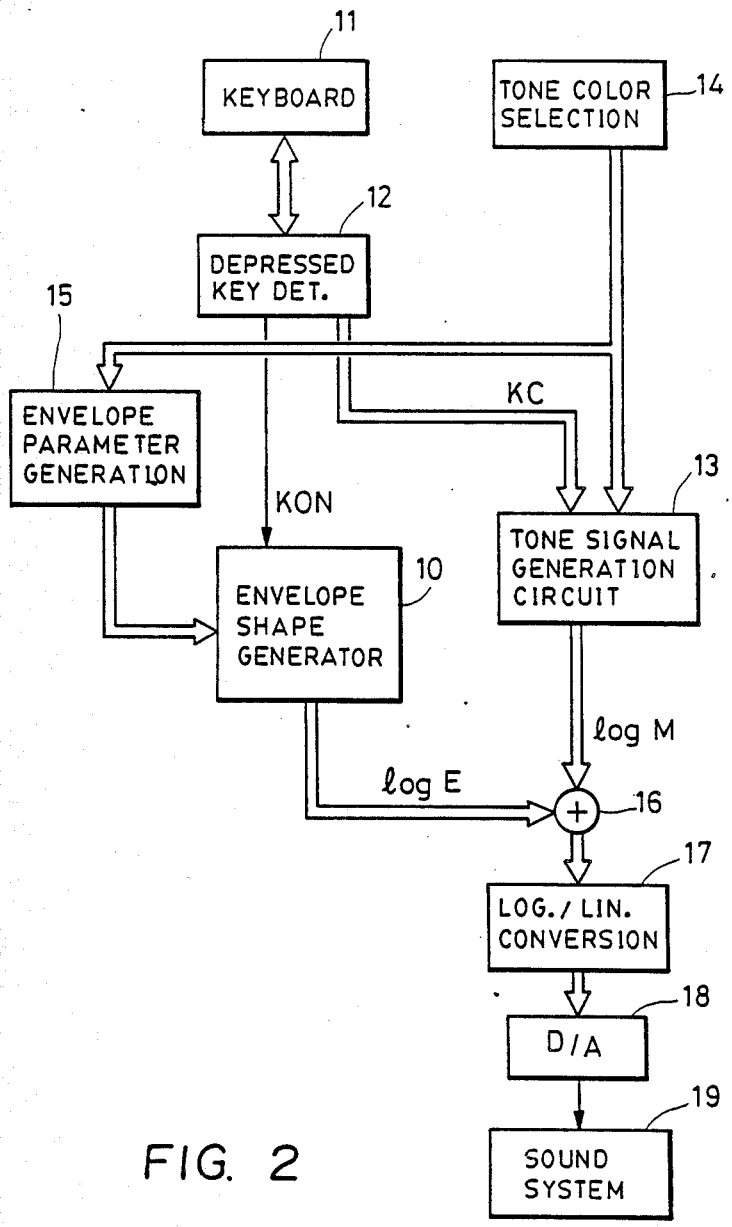
FIG. 2 is a block diagram showing an example of construction of an electronic musical instrument incorporating the envelope shape generator of the above embodiment.

FIG. 1 shows an embodiment of an envelope shape generator 10 according to the invention and FIG. 2 shows an example of an electronic musical instrument using this envelope shape generator 10 for generating a tone volume amplitude envelope shape of a tone.

Referring to FIG. 2, a keyboard 11 comprises plural keys for designating tone pitch of a tone to be generated and a key designated on this keyboard 11 is detected by a depressed key detection circuit 12. The depressed key detection circuit 12 produces a key code KC and a key-on signal KON. The key code KC is supplied to a tone signal generation circuit 13 and the key-on signal KON is supplied to the envelope shape generator 10. The tone signal generation circuit 13 generates a tone signal of a tone pitch corresponding to the supplied key code KC with a tone color selected by a tone color selection circuit 14. It is assumed that, in this example, the tone signal generated by the tone signal generation circuit 13 is data log M in decibel representation (i.e., represented in logarithm).

Figure 3A:
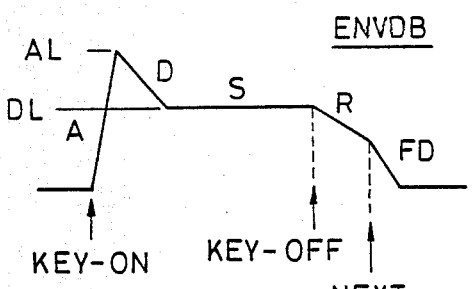
FIGS. 3*a* through 3*c* are diagrams showing examples of an envelope shape in the embodiment shown in FIG. 1.

An envelope parameter generation circuit 15 generates, in accordance with the tone color selected by the tone color selection circuit, various parameter data for determining rates of change and levels in portions of an envelope shape generated by the envelope shape generator 10 such as attack, decay, sustain, release and forcing damp portions. Parameter data which determine rates of change include attack rate data AR, decay rate data DR, sustain rate data SR, release rate data RR and forcing damp rate data FR. These change rate data determine inclinations of the respective portions of the envelope shape as shown in FIG. 3*a*. Parameter data which determine levels include attack level data AL and decay level data DL. These level data AL and DL determine attack level and decay level in the envelope shape as shown in FIG. 3*a*. The generated parameter data are supplied to the envelope shape generator 10.

The envelope shape generator 10 generates envelope shape data log E in decibel representation (represented in logarithm) in response to the various parameter data and the key-on signal KON. An adder 16 adds the decibel tone signal data log M in decibel representation and the envelope shape data log E together to produce product of E and M (E·M) represented in logarithm, i.e., $$\log E + \log M = \log (E \cdot M)$$

By this addition, a tone volume amplitude envelope is imparted to the tone signal. The output of the adder 16 is applied to a logarithm/linear conversion circuit 17 which thereupon produces tone signal data E M imparted with the tone volume amplitude envelope in linear representation. This tone signal data is converted to an analog signal by a digital-to-analog conversion circuit 18 and thereafter is supplied to a sound system 19.

Referring now to FIG. 1, the envelope shape generator 10 will be described.

In this envelope shape generator 10, an operation circuit 20 generates envelope shape data ENVDB as shown in FIG. 3*a* by regularly and repetitively adding or subtracting, at each clock pulse $\phi$, the attack rate data AR, decay rate data DR, sustain rate data SR, release rate data RR and forcing damp rate data FR corresponding to the respective portions of attack, decay, sustain, release and forcing damp. It is assumed that this envelope shape data ENVDB is data in decibel representation and expressed in amount of attenuation with 0 dB constituting maximum level. When, accordingly, all bits of this data ENVDB are "0", it represents the maximum level 0 dB and when all bits thereof are "1", it represents zero level.

A control signal for controlling the operation circuit 20 is produced on the basis of the key-on signal KON. The key-on signal KON is applied to a rise and fall differentiation circuit 22 through an AND gate 21 and one shot of key-on pulse KONP and one shot of key-off pulse KOFP are generated respectively upon rising (i.e., when a key has been depressed) and falling (i.e., when the key has been released) of the key-on signal KON. An output of a flip-flop 23 which is applied to the other input of the AND gate 21 is normally "1" and is turned to "0" when one of conditions for performing forcing damp has been satisfied.

All bits of the envelope shape data ENVDB provided by the operation circuit 20 are applied to an AND gate 24 and an output signal "1" of this AND gate 24 at the time when all bits which are all "1" is applied to a set input S of the flip-flop 23 as a signal ALL "1". A signal obtained by inverting this signal ALL "1" is applied to an AND gate 25. To the other input of the AND gate 25 is applied the key-off pulse KOFP and the output of the AND gate 25 is applied to a reset input R of the flip-flop 23. Upon reducing of the envelope shape level to zero before release of a depressed key (i.e., before generation of the key-off pulse KOFP), the signal "0" obtained by inverting the signal ALL "1" disables the AND gate 25 whereby the flip-flop 23 is not reset even if the key-off pulse KOFP is generated by releasing of the key thereafter. In this case, no condition for performing forcing damp is satisfied.

On the other hand, if the key has been released before the envelope shape is reduced to zero, the output of the AND gate 25 is turned to "1" because the key-off pulse KOFP is generated before the signal ALL "1" is produced and the flip-flop 23 thereby is reset. This causes the output of the flip-flop 23 to become "0" and thereby causes the AND gate 21 to be disabled and causes an AND gate 26 to be enabled by a signal "1" obtained by inverting the output "0" of the flip-flop 23. The AND gate 26 receives the key-on signal KON at the other input thereof. If a new key has been depressed while the AND gate 26 is enabled in response to the output "0" of the flip-flop 23, AND condition of the AND gate 26 is satisfied by rising of a new key-on signal KON and the output of the AND gate 26 is turned to "1" . This output signal "1" of the AND gate 26 constitutes the forcing damp signal FD. If, on the other hand, the envelope shape level of a preceding tone has been reduced to zero before a new key has been depressed, the flip-flop 23 is set by the signal ALL "1" so that the forcing damp signal FD is not generated. Thus, on conditions that the depressed key has been released and a new key has been depressed before the envelope shape level has been reduced to zero, the forcing damp signal FD is generated and the forcing damp operation is performed as will be described more fully later in accordance with this forcing damp signal FD.

The key-on pulse KONP and key-off pulse KOFP generated by the rise and fall differentiation circuit 22 are supplied to a counter 27 for controlling the operation mode of the operation circuit 20. This counter 27 is a binary counter of 2 bits and is reset to "00" in response to the key-on pulse KONP, counts up by 1 count at a timing of the clock pulse $\phi$ which is applied to a clock terminal CLK when the output signal of an AND gate 28 applied to an enable terminal EN is "1", and loads "11" in response to the key-off pulse KOFP. The 2-bit output of this counter 27 is utilized as mode signals MD0 and MD1. Relation between contents of the mode signals MD0 and MD1 and the operation mode is as described in the following table 1:

TABLE 1

| MD1 | MD0 | (Decimal) | Mode |
|---|---|---|---|
| 0 | 0 | (0) | attack |
| 0 | 1 | (1) | decay |
| 1 | 0 | (2) | sustain |
| 1 | 1 | (3) | release |

A signal obtained by inverting the signal MD1 is applied to the AND gate 28 to enable the counter 27 to count up only during attack or decay. The AND gate 28 receives at the other input thereof an output of a comparator 30 comparing the envelope shape data ENVDB with the attack level data AL or decay level data DL through an OR gate 29 as described later.

A selector 31 selects one of the attack rate data AR, decay rate data DR, sustain rate data SR and release rate data RR in accordance with contents of the mode signals MD0 and MD1 and supplies its output to a "0" input of a selector 32. The selector 32 receives at its "1"

input the forcing damp rate data FR and selects forcing damp rate data FR applied to the "1" input in the forcing damp operation mode in response to the forcing damp signal FD and selects the output of the selector 31 applied to the "" input in other modes. The output of the selector 32 is applied to an inversion control circuit 33. Since the envelope shape data ENVDB formed by the operation circuit 20 is the amount of attenuation as described before, a rise characteristic such as the attack portion can be obtained by repetitively subtracting the rate data whereas a decay characteristic such as the decay portion can be obtained by repetitively adding the rate data. The inversion control circuit 33 is provided for performing the subtraction by addition of complements in this case.

In the operation circuit 20, results of arithmetic operation are accumulated in a register 34 and result of the preceding operation accumulated in the register 34 and rate data supplied through the inversion control circuit 33 are added together (or subtracted in case of addition of complements) by an adder 35. The output of this adder 35 is accumulated in the register 34 through an OR gate group 36, AND gate group 37 and selector 80. The selector 80 selects an output of a reverse conversion table 82 only when a pulse "1" has been produced by a rise differentiation circuit 81 upon rising of the forcing damp signal FD from "0" to "1" and otherwise selects an output of the AND gate group 37.

A signal "1" is initially applied to all OR gates in the OR gate group 36 in response to the key-on pulse KONP whereby all "1" are set in the register 34. The output of this register 34 is provided as the envelope shape data ENVDB by the operation circuit 20. Since the mode is initially the attack mode, output of a NOR gate 39 which receives the mode signals MD0 and MD1 is "1" and this output signal is supplied as a signal commanding subtraction to the inversion control circuit 33, adder 35 and AND gate 40. The inversion control circuit 33 consists of exclusive OR gates of a number corresponding to the bit number of the rate data supplied by the selector 32 and inverts respective bits of the rate data supplied by the selector 32 when the signal supplied from the NOR gate 39 is "1" whereas it passes the rate data without inversion when the signal supplied from the NOR gate 39 is "0". The output signal "1" of the NOR gate 39 is applied to a carry input Ci of the least significant digit of the adder 35 which thereupon performs addition of complements, i.e., subtraction, by adding 1 to the inverted rate data. In the foregoing manner, in the attack mode, the attack rate data AR selected by the selectors 31 and 32 are repetitively subtracted from all "1" which were initially set in the operation circuit 20 whereby the envelope shape data ENVDB expressed in the amount of attenuation rises with a certain inclination as shown in FIG. 3*a*.

In the attack mode, the attack level data AL is selected by the selector 41 and applied to B input of the comparator 30. The comparator 30 receives at its A input the envelope shape data ENVDB from the operation circuit 20. When the two data coincide with each other, a signal "1" is supplied from output B=A to the OR gate 29. Depending upon the value of the rate data, the condition B=A is not necessarily achieved but may be exceeded in some case. Therefore, output B<A of the comparator 30 is supplied to a change detection circuit consisting of a delay flip-flop 42 and an exclusive OR gate 43 and output of this change detection circuit is applied to the OR gate 29. Upon reaching of the value of the envelope shape data ENVDB to the value of the attack level data AL, the output of the OR gate 29 is turned to "1" and a signal "1" is supplied to the counter 27 through the AND gate 28 whereby the counter 27 counts up by 1. The mode thereby is changed to the decay mode.

The AND gate 40 is provided to maintain the value of the envelope shape data ENVDB at all "0" by closing the AND gate group 37 in a case where the envelope shape data ENVDB have become all "0" before it reaches the value of the attack level data. In a state before result of subtraction becomes all "0" during the subtraction, a signal "1" is produced each time from a carry output Co of the adder 35 so that the AND gate 40 to which a signal obtained by inverting this signal "1" is applied is not enabled and, accordingly, the gate of the AND gate group 37 to which a signal obtained by inverting the output of the AND gate 40 is applied is open. If, however, result of the subtraction has become all "0" or exceeded it, a signal "1" is not produced from the carry output Co any longer so that the output of the AND gate 40 is turned to "1" and the gate of the AND gate group 37 thereby is closed. The envelope shape data ENVDB thereby maintains all "0" which is the maximum value.

Upon changing to the decay mode, the output of the NOR gate 39 becomes "0" thereby commanding addition. The decay rate data DR is supplied to the operation circuit 20 through the selectors 31 and 32 and this decay rate data DR is repetitively added to the present value of the envelope shape data ENVDB. The envelope shape data ENVDB thereby is attenuated with a certain inclination as shown in FIG. 3*a*. In the decay mode, the decay level data DL is selected by the selector 41 and supplied to the B input of the comparator 30. Upon reaching of the value of the envelope shape data ENVDB to the value of the decay level data DL, the output of the OR gate 29 is turned to "1" and a signal "1" is supplied to the counter 27 through the AND gate 28 causing the counter 27 to count up by 1. Thus, the mode is changed to the sustain mode.

In the sustain mode, the sustain rate data SR is supplied to the operation circuit 20 through the selectors 31 and 32 and the sustain level data SR is repetitively added to the present value of the envelope shape data ENVDB. The envelope shape data ENVDB thereby is gradually attenuated with a certain inclination as shown in FIG. 3*a*.

Upon generation of the key-off pulse KOFP by release of the depressed key, "11" is loaded in the counter 27 whereby the mode is changed to the release mode. In the release mode, the release rate data RR is supplied to the operation circuit 20 through the selectors 31 and 32 and this release rate data RR is repetitively added to the present value of the envelope shape data ENVDB. The envelope shape data ENVDB thereby is attenuated with a certain inclination as shown in FIG. 3*a*.

In a case where the condition of forcing damp has been achieved during the release mode and the forcing damp signal FD has been produced, the forcing damp rate data FR is selected by the selector 32 and supplied to the operation circuit 20. In the operation circuit 20, this forcing damp rate data FR is repetitively added to the present value of the envelope shape data ENVDB. The envelope shape data ENVDB thereby is rapidly attenuated with a certain inclination as shown in FIG. 3*a*. At the beginning of the forcing damp, the selector 80 selects the output of the reverse conversion table 82 thereby causing an initial value of the envelope shape data ENVDB to be determined. The reason therefor will be described later.

The AND gate 44 is provided for maintaining the value of the envelope shape data ENVDB at all "1" when a carryout signal has been produced from the adder 35, i.e., the result of the addition has exceeded all "1", during the addition. The AND gate 44 receives the carry output Co and a signal obtained by inverting the output of the NOR gate 39. When the carryout signal has been produced from the adder 35 during the addition, a signal "1" is applied from the AND gate 44 to the OR gate group 36 through the OR gate 38 thereby turning the value of the envelope shape data ENVDB to all "1".

The envelope shape data ENVDB produced by the operation circuit 20 is applied to a curve conversion table 45 and "0" input of a selector 46. The output of the curve conversion circuit 45 is applied to "1" input of the selector 46. An output signal of a NOR gate 47 receiving the mode signals MD0 and MD1 becomes "1" in the attack mode and this output signal and the forcing damp signal FD via a delay flip-flop 83 for timing synchronizing are applied to a control input of the selector 46 through an OR gate 48. The selector 46 therefore selects the output of the curve conversion table 45 in the attack mode and the forcing damp mode and in other modes it selects directly the envelope shape data ENVDB produced by the operation circuit 20.

Figure 4:
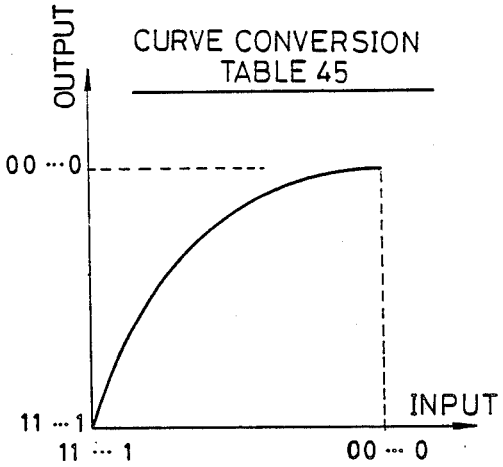
FIG. 4 is a diagram showing an example of conversion characteristic of a curve conversion table in FIG. 2.

The curve conversion table 45 converts the input envelope shape data ENVDB with a characteristic as shown in FIG. 4. This characteristic is a logarithmic conversion characteristic whose inclination becomes steeper as the amount of attenuation becomes larger and becomes more gradual as the amount of attenuation becomes smaller.

Figure 3B:
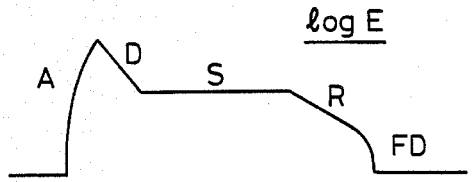

In the attack mode, the envelope shape data ENVDB changes linearly (i.e., rises) with inclination corresponding to the attack rate from all "1" corresponding to the maximum level to a value corresponding to the attack rate data AL. The curve conversion table of the characteristic as shown in FIG. 4 therefore is read out in a forward direction and, as a result, the envelope shape data of the attack portion is converted to a characteristic as shown in FIG. 3*b* whose inclination of rising is steep at the beginning and becomes relatively gradual thereafter.

In the forcing damp mode, the envelope shape data ENVDB changes linearly (i.e., falls) with inclination corresponding to the forcing damp rate from a value corresponding to the level at the end of the release portion to all "1" corresponding to the maximum level. The curve conversion table 45 as shown in FIG. 4 is reversely read out and, as a result, the envelope shape data of the forcing damp portion is converted to a characteristic as shown in FIG. 3*b* whose inclination of attenuation is relatively gradual at the beginning and thereafter becomes increasingly steeper.

The reverse conversion table 82 is a table in which the input-output relation of the curve conversion table 45 is reversed, i.e., the envelope shape data ENVDB is applied and data corresponding thereto is read out and applied to the selector 80. If this processing was not performed, data read out from the curve conversion table 45 at the beginning of the forcing damp would not necessarily be connected smoothly to the data ENVDB at the end of the release portion. By reading, from the reverse conversion table 82, input data of the curve conversion table 45 necessary for causing the curve conversion table 45 to produce data which is the same as the data ENVDB at the end of the release portion, selecting this data by the selector 80 at the beginning of the forcing damp and applying it to the curve conversion table 45 as the envelope shape data ENVDB, data which is the same as the data ENVDB at the end of the release portion is provided as envelope shape data (log E) at the beginning of the forcing damp from the curve conversion table 45 whereby the data ENVDB at the end of the release portion can be connected smoothly to the envelope shape data (log E).

In the foregoing manner, envelope shape data (see FIG. 3*b*) which is obtained by converting the characteristic of change curve in the attack portion and the forcing damp portion is provided from the selector 46 and this data is provided by the envelope shape generator 10 as the envelope shape data log E expressed in decibel representation.

As described above, a tone signal which has been controlled by this envelope shape data log E in decibel representation is applied to the logarithm/linear conversion circuit 17 (FIG. 2) in which the data is finally converted to linear data. By this linear conversion, the envelope shape in decibel representation shown in FIG. 3*b* is converted to the characteristic shown in FIG. 3*c*. Accordingly, the attack portion rises steeply and the forcing damp portion attenuates rapidly.

Figure 5:
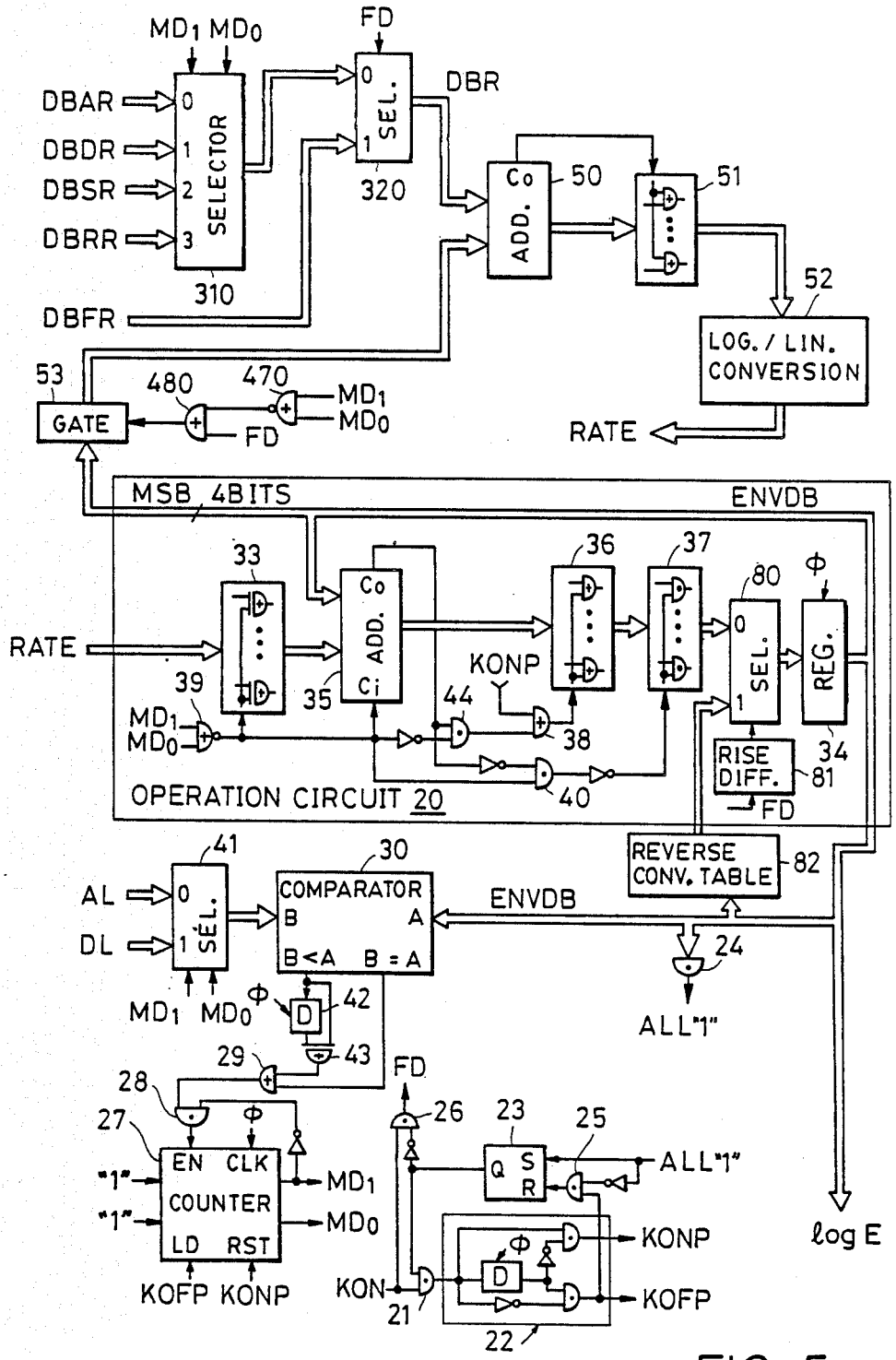
FIG. 5 is a block diagram showing another embodiment of the envelope shape generator according to the invention.

FIG. 5 shows another embodiment of the envelope shape generator 10. This embodiment realizes imparting of rate data in decibel representation and determination of curves of the attack portion and the forcing damp portion to desired characteristics by changing rate data provided to the operation circuit 20 in accordance with the level of the envelope shape. In FIG. 5, components designated by the same reference characters as those used in FIG. 1 perform the same function so that detailed description thereof will be omitted.

In FIG. 5, selectors 310 and 320 correspond to the selectors 31 and 32 of FIG. 1 but are different in that rate data DBAR, DBDR, DBSR, DBRR and DBFR are data of decibel representation. If the rate data is determined in decibel representation, dynamic range of rate data which can be determined by a limited number of bits can be enlarged as shown in the following Table 2. In Table 2, an example of weight of each bit of 6-bit binary data weighted in decibel representation and weight of each bit of the data converted to data of linear representation is shown. The art of determining information of time function type such as an envelope shape is disclosed in Japanese Patent Publication No. 24433/1984 so that description of this art will be omitted.

TABLE 2

| Bit | MSB 6 | 5 | 4 | 3 | 2 | LSB 1 |
|---|---|---|---|---|---|---|
| Weight in decibel representation | 48 | 24 | 12 | 6 | 3 | dB 1.5 |
| Weight of linear converted data | $2^{32}$ | $2^{16}$ | $2^{8}$ | $2^{4}$ | $2^{2}$ | $2^{1}$ |

In other words, 6-bit binary data in linear representation can represent only data within the range of 0–32 whereas 6-bit binary data in decibel representation can represent data within the range of $1-2^{32}$ if it is converted to data of linear representation.

The rate data DBR in decibel representation produced by the selector 320 (one of the data DBAR-DBFR selected by the selectors 310 and 320) is supplied to a logarithm/linear conversion circuit 52 through an adder 50 and an OR gate group 51 and, after being converted to rate data in linear representation (designated as RATE), is applied to the inversion control circuit 33 in the operation circuit 20.

The adder 50, OR gate group 51 and gate 53 are provided for performing the same function as the curve conversion table 45 in FIG. 1 (i.e., the function of forming the envelope shape data in the attack portion with the characteristic whose inclination of rising is steep at the beginning and becomes relatively gradual thereafter as shown in FIG. 3*b* and forming the envelope shape data in the forcing damp portion with the characteristic whose inclination of attenuation is relatively gradual at the beginning and becomes increasingly steeper thereafter). The leftmost 4 bits of the envelope shape data ENVDB formed by the operation circuit 20 are applied to the gate 53 and an output of a logic consisting of a NOR gate 470 and an OR gate 480 operating under the same conditions as the NOR gate 47 and OR gate 48 in FIG. 1 is applied to a control input of the gate 53.

The adder 50 adds the rate data DBR in decibel representation provided from the selector 320 and the leftmost 4-bit data of the envelope shape data ENVDB provided from the gate 53 together. The output of the adder 50 is supplied to the logarithm/linear conversion circuit 52 via the OR gate group 51. The OR gate group 51 supplies a signal whose all bits are "1" to the logarithm/linear conversion circuit 52 when the carry out signal has been generated from a carry output Co of the adder 50 and otherwise supplies the output of the adder 50 directly to the logarithm/linear conversion circuit 52. A carryout signal is produced when result of addition in the adder 50 has overflowed exceeding the maximum value, i.e., all bits "1" thereby compulsorily turning the data to be supplied to the logarithm/linear conversion circuit 52 to the maximum value, i.e., all bits "1".

In modes other than the attack mode and the forcing damp mode, i.e., in the decay, sustain and release modes, the output of the OR gate 480 is "0" so that the gate 53 is closed and data applied from the gate 53 to one input of the adder 50 is "0". Accordingly, the rate data DBR in decibel representation provided from the selector 320 is directly supplied to the logarithm/linear conversion circuit 52.

On the other hand, in the attack mode or forcing damp mode, the output of the OR gate 480 is "1" so that the gate 53 is opened and the leftmost 4-bit data of the envelope shape data ENVDB is supplied to one input of the adder 50 through the gate 53. The rate data DBR (the attack rate data DBAR or the forcing damp rate data DBFR) provided from the selector 320 is added to the leftmost 4-bit data of the envelope shape data ENVDB by the adder 50. Since the envelope shape data ENVDB is also data in decibel representation, the adder 50 substantially performs multiplication by addition of the two data in decibel representation.

If the rate data DBR is 6-bit data weighted as shown in Table 2 and the leftmost 4 bits of the envelope shape data ENVDB is weighted as shown in the following Table 3, the adder 50 performs addition of two 6-bit data by adding "00" of 2 bits to the least significant bit of the 4-bit ENVDB and thereby matching the weights of the bits of the two data as follows:

TABLE 3

| Bit | MSB 6 | 5 | 4 | 3 | 2 | LSB 1 |
|---|---|---|---|---|---|---|
| Weight of DBR | 48 | 24 | 12 | 6 | 3 | dB 1.5 |
| Weight of leftmost 4 bits of ENVDB | 48 | 24 | 12 | dB 6 | | |

In the operation in this adder 50, the leftmost 4 bits of ENVDB function to increase the value of rate data RATE in linear representation corresponding to the rate data DBR by $2^n$ fold as shown in the following Table 4 in accordance with the level of the envelope shape data ENVDB. Alternatively stated, by adding value n (n being a decimal number and n=1 corresponds to 6 dB) of the leftmost 4 bits of ENVDB in decibel representation to the rate data DBR in decibel representation, the rate data RATE in linear representation which is obtained by converting the result of the addition by the logarithm/linear conversion circuit 52 is $2^n$ fold of a value in linear representation corresponding to the original rate data DBR.

TABLE 4

| Leftmost 4 bits of ENVDB 48 | 24 | 12 | (dB) 6 | Amount of attenuation of ENVDB | Rate of multiplication of RATE |
|---|---|---|---|---|---|
| 0 | 0 | 0 | 0 | 0 dB and over | $2^0 = 1$ |
| 0 | 0 | 0 | 1 | 6 dB and over | $2^1$ |
| 0 | 0 | 1 | 0 | 12 dB and over | $2^2$ |
| 0 | 0 | 1 | 1 | 18 dB and over | $2^3$ |
| 0 | 1 | 0 | 0 | 24 dB and over | $2^4$ |
| 0 | 1 | 0 | 1 | 30 dB and over | $2^5$ |
| 0 | 1 | 1 | 0 | 36 dB and over | $2^6$ |
| 0 | 1 | 1 | 1 | 42 dB and over | $2^7$ |
| 1 | 0 | 0 | 0 | 48 dB and over | $2^8$ |
| 1 | 0 | 0 | 1 | 54 dB and over | $2^9$ |
| 1 | 0 | 1 | 0 | 60 dB and over | $2^{10}$ |
| 1 | 0 | 1 | 1 | 66 dB and over | $2^{11}$ |
| 1 | 1 | 0 | 0 | 72 dB and over | $2^{12}$ |
| 1 | 1 | 0 | 1 | 78 dB and over | $2^{13}$ |
| 1 | 1 | 1 | 0 | 84 dB and over | $2^{14}$ |
| 1 | 1 | 1 | 1 | 90 dB and over | $2^{15}$ |

In other words, each time the amount of attenuation of the envelops shape data ENVDB increases by 6 dB (the level falls by 6 dB), i.e., the amount of attenuation of the envelope shape data ENVDB has amounted to n×6 dB, the value of the rate data RATE in linear representation increases by $2^n$ fold as compared to the value when the amount of attenuation was 0 to less than 6 dB. This means that the value of the rate data RATE is switched to $2^n$ fold in accordance with the range of every 6 dB of the envelope shape data ENVDB in such a manner that the lower the level of the envelope shape, the steeper is the inclination of change of the envelope shape.

In this manner, as to the attack portion and the forcing damp portion, each time the level of the envelope shape data ENVDB formed in the operation circuit 20 has changed by 6 dB in correspondence to the present level of the envelope shape data, the value of the rate data RATE which is to be repetitively added or subtracted in the operation circuit 20 is switched to $2^n$ fold (the smaller the level of the envelope shape, the larger is n) and the envelope shape data ENVDB provided finally by the operation circuit 20 becomes data of the characteristic shown in FIG. 3*b*. That is, the envelope shape data in the attack portion is generated with the characteristic whose inclination of rising is steep at the beginning and becomes relatively gradual thereafter and the envelope shape data in the forcing damp portion is generated with the characteristic whose inclination of attenuation is relatively gradual at the beginning and becomes increasingly steeper thereafter.

As described above, in the attack portion and the forcing damp portion, the envelope shape data ENVDB in decibel representation having desired characteristics as shown in FIG. 3*b* is produced by the operation circuit 20 and this data is provided by the envelope shape generator 10 as the envelope shape data log E.

The embodiment of FIG. 5 is advantageous in that, as described previously, the dynamic range which is determined with a limited number of bits can be enlarged because the rate data DBAR - DBFR are determined in decibel representation. Further, this embodiment is advantageous in that its circuit construction is simplified as compared with the embodiment of FIG. 1 because the same function as in the embodiment of FIG. 1 is performed by a simple operation circuit consisting of the adder 50, OR gate group 51 and gate 53 instead of using the curve conversion table 45 of FIG. 1.

The embodiment of FIG. 5 is also advantageous in that, since the envelope shape data ENVDB formed in the operation circuit 20 directly constitutes the envelope shape data log E provided by the envelope shape generator 10, determining of the attack level data AL is easy. The envelope shape data log E corresponds to desired envelope shape data to be determined and it is normal that a desired attack level is determined in the scale of this envelope shape data log E. Since, in the embodiment of FIG. 5, the envelope shape data ENVDB which is compared with the attack level data AL by the comparator 30 directly constitutes the envelope shape data log E, the attack level data AL can be instantly obtained in accordance with the attack level determined in the scale of this envelope shape data log E. In contrast, in the embodiment of FIG. 1, data obtained by converting the envelope shape data ENVDB formed in the operation circuit 20 by the curve conversion table 45 constitutes the envelope shape data log E and, accordingly, the attack level data AL must be determined by somewhat complex operation, namely converting a desired attack level determined in the scale of the envelope shape data log E with the reverse conversion characteristic of the conversion characteristic of the curve conversion table 45 and thereby converting it in the scale of the envelope shape data ENVDB.

Figure 6:
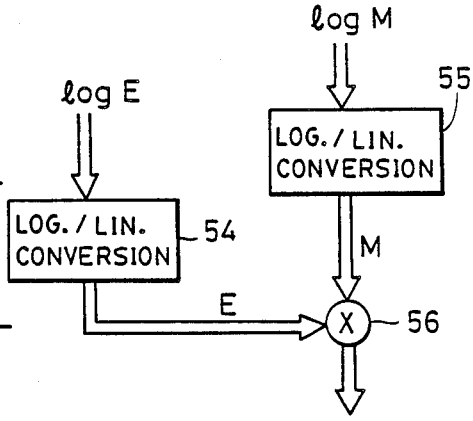
FIG. 6 is a block diagram showing a modified example of FIG. 2.

The portion of the adder 16 and the logarithm/linear conversion circuit 17 in FIG. 2 may be modified as shown in FIG. 6. In this example, an amplitude envelope is imparted to a tone signal by separately converting tone signal data log M and envelope shape data log E respectively in decibel representation to linear representation by logarithm/linear conversion circuits 54 and 55 and thereafter multiplying them with each other by a multiplier 56. In this case, the logarithm/linear conversion circuit 55 is unnecessary if the tone signal generation circuit 13 generates the tone signal data M in linear representation.

The envelope shape generator according to the invention is applicable not only to the envelope shape generator for determining amplitude of tone volume as described above but also to an envelope shape generator for determining timewise changing characteristics of tone color and other envelope shape generators used for control of a tone signal.

An embodiment of an envelope shape generator 101 comprising an envelope control device 60 for performing mute control will now be described with reference to FIG. 7.

Figure 7:
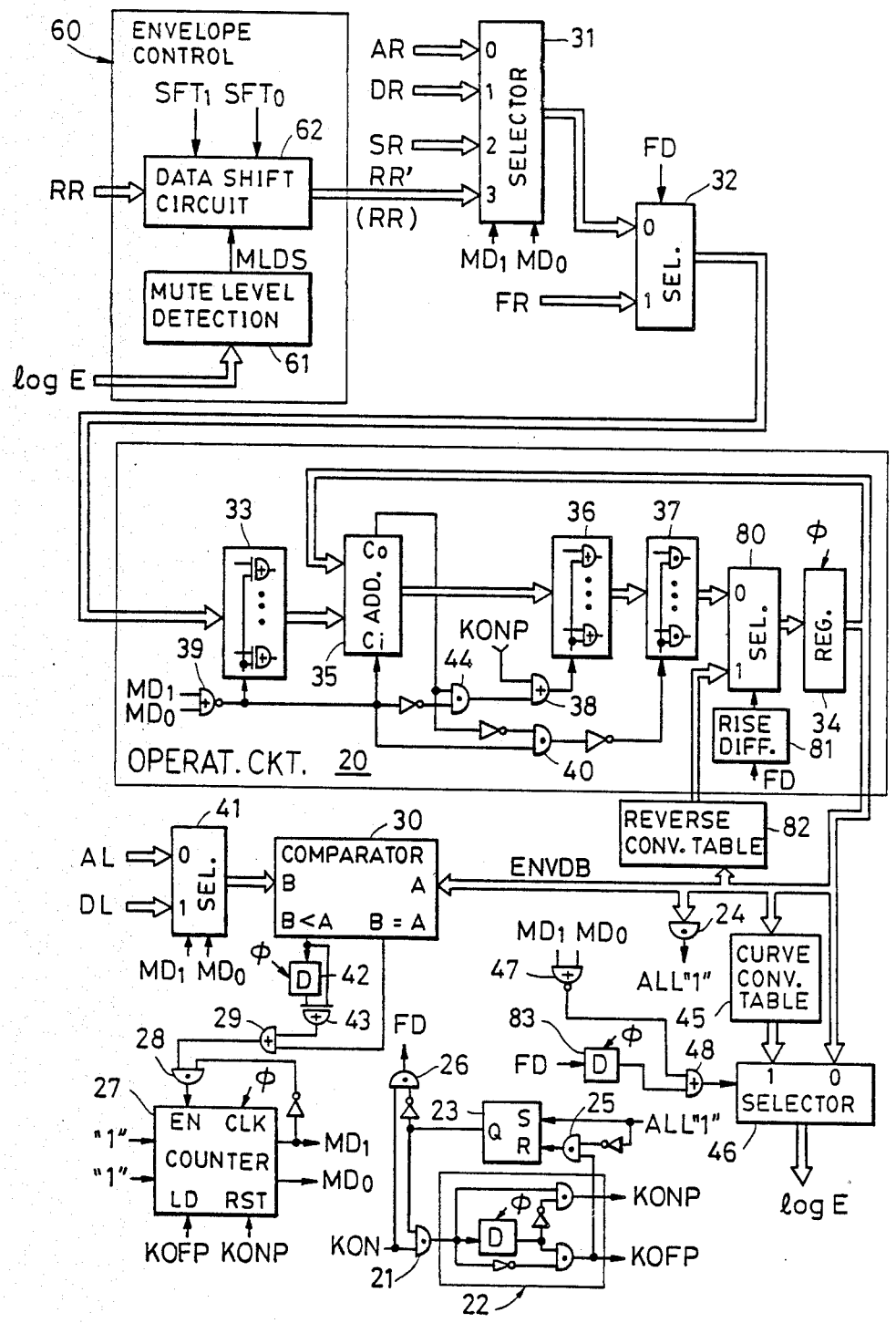
FIG. 7 is a block diagram showing another embodiment of the envelope shape generator according to the invention.

In the envelope shape generator 101 of FIG. 7, the portion other than the envelope control device 60 is the same as the envelope shape generator 10 of FIG. 1. Accordingly, the description already made with respect to FIG. 1 should be referred to as to the component parts other than the envelope control device 60.

Figure 3C:
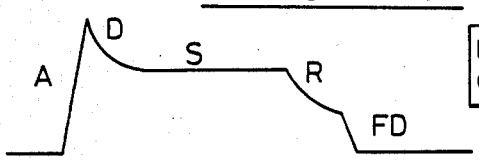
Figure 8A:
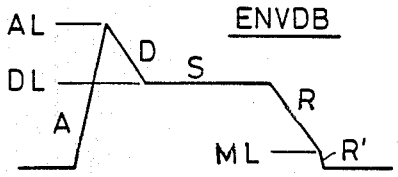
FIGS. 8*a* through 8*c* diagrams showing examples of an envelope shape in this embodiment.

In the embodiment of FIG. 7 also, the forcing damp control shown in FIGS. 3*a*–3*c* is performed when the forcing damp condition as described above has been satisfied. In the embodiment of FIG. 7, however, when the forcing damp condition is not satisfied, i.e., normally, the envelope shape data ENVDB is formed in accordance with a characteristic as shown in FIG. 8*a*. It should be noted that, when the level of the envelope shape in the release portion R has dropped below a predetermined mute level ML, a control for rapidly attenuating the envelope shape (hereinafter referred to as mute control, a portion corresponding to the mute control is designated by R') is performed. This mute control is performed by the envelope control device 60. In the embodiment of FIG. 7, release rate data RR is applied to the envelope control device 60 and its value is changed when the mute control is performed. In the release mode, the operation circuit 20 performs operation in accordance with normal release data RR but when the mute control is performed, the operation circuit 20 performs operation in accordance with release data RR' which has been modified by the envelope control device 60.

The envelope control device 60 comprises a mute level detection circuit 61 which receives envelope shape data log E generated by the envelope shape generator 101 and detects that its level has dropped below a predetermined mute level ML corresponding to the minimum level at which a tone waveshape can be effectively represented and a data shift circuit 62 which modifies the release data RR to RR' for rapidly attenuating the envelope shape in response to the detection by the mute level detection circuit 61. The mute level ML is determined, for example, at −60 dB. When the envelope shape level is larger than the mute level ML, the data shift circuit 62 provides the release rate data RR directly without shifting it. When the envelope shape level has dropped below the mute level ML, the data shift circut 62 shifts the release data RR to data of a larger value and provides the shifted data RR'. Since the rate data RR' used in the mute control is larger than the normal release rate data RR, the mute portion R' attenuates more rapidly than the normal release portion R.

To the selector 31 are applied attack rate data AR, decay rate data DR and sustain rate data SR which are respectively provided by the envelope parameter generation circuit 15 (FIG. 2) and the release rate data RR' (or RR) provided through the data shift circuit 62 of the envelope control device 60. This selector 31 selects, as described above, any one of the attack rate data AR, decay rate data DR, sustain rate data SR and release rate data RR' (or RR) in accordance with contents of the mode signals MD0 and MD1 as described previously and the output of the selector 32 is applied to "0" input of the selector 32.

The operations of the envelope shape generator 101 in the attack mode, decay mode and sustain mode are the same as those already described with reference to FIG. 1.

In the release mode, the release data RR' (or RR) is supplied to the operation circuit 20 through the selectors 31 and 32 and this release data RR' (or RR) is added repetitively to the present value of the envelope shape data ENVDB.

As described above, since the level of the envelope shape data log E is normally larger than the predetermined mute level ML at the beginning of release, the data shift circuit 62 of the envelope control device 60 provides the release data RR directly without shifting it. The operation circuit 20 thereby adds the normal release data RR repetitively and the envelope shape data ENVDB thus obtained atenuates with a certain inclination corresponding to the release data RR as shown in the portion R in FIG. 8*a*.

When the level of the envelope shape data log E corresponding to the envelope shape data ENVDB has dropped below the mute level ML, this state is detected by the detection circuit 61 and, accordingly, the data shift circuit 62 shifts the release rate data RR to MSB side by a predetermined number of bits and provides the rate data RR' of an enlarged value. The operation circuit 20 therefore adds the release data RR' of the enlarged value repetitively and the envelope shape data ENVDB thus obtained attenuates rapidly with an inclination which is steeper than the portion R as shown in FIG. 8*a*. For determining and controlling the shift amount in the data shift circuit 62, shift data SFT1 and SFT0 are supplied from the envelope parameter generation circuit 15 (FIG. 2). The shift data SFT1 and SFT0 are determined in accordance with, e.g., tone color. The inclination of rapid attenuation in the mute portion R' is variably controlled by the shift data SFT1 and SFT0. In other words, the rapid attenuation characteristic in the mute portion R' can be determined in accordance with tone color.

Figure 8B:
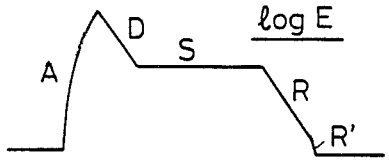
Figure 8C:
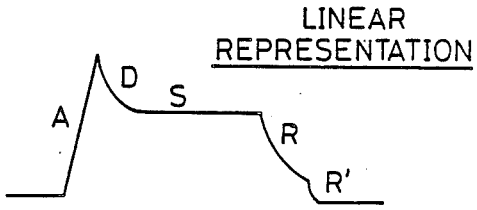

When, as described above, the forcing damp signal FD has risen from "0" to "1", i.e., the mode has been changed to the forcing damp mode, the selector 80 of the operation circuit 20 selects the output of the reverse conversion table 82 thereby causing the processing of the forcing damp to be performed. When the forcing damp is not performed, the selector 80 always selects the output of the AND gate group 37 so that, as described above, the mute control according to which the portion R of the release portion attenuates rapidly in the region below the mute level ML. FIG. 8*b* shows an example of the output log E of the selector 46 when the mute control is performed and FIG. 8*c* shows an example of the envelope shape obtained by converting this output to data of linear representation.

Figure 9:
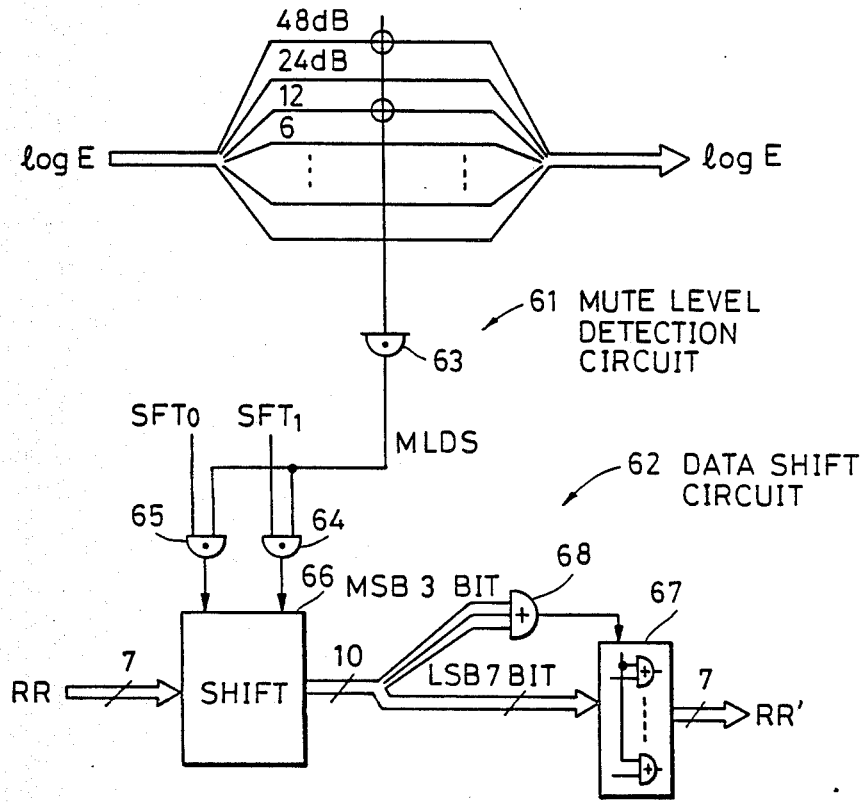
FIG. 9 is a block diagram showing a specific example of the envelope control device of FIG. 1.

FIG. 9 shows a specific example of the envelope control device 60 in FIG. 7. A mute level detection circuit 61 consists of an AND gate 63 receiving a bit corresponding to weight of 48 dB and a bit corresponding to weight of 2 dB among the bits of the envelope shape data log E in decibel representation. By this arrangement, when the level of the envelope shape data log E has dropped below −60 dB, the respective bits applied to the AND gate 63 become "1" whereby the fact that the level of the envelope shape data log E has dropped below the predetermined mute level ML (−60 dB in this case) is detected. The output of the AND gate 63 is applied as a mute level detection signal MLDS to AND gates 64 and 65 of the data shift circuit 62.

The data shift circuit 62 comprises a shift circuit 66 whose shift amount is determined by 2-bit shift data SFT1 and SFT0 supplied from AND gates 64 and 65. This shift circuit 66 receives the release data RR and shifts this data RR in accordance with the determined shift amount. The AND gates 64 and 65 are enabled when the mute level detection signal MLDS is "1" and the shift data SFT1 and SFT0 are thereby supplied to the shift circuit 66. Relationship among the shift data SFT1 and SFT0, shift amount and times of multiplication is shown in the following Table 5:

TABLE 5

| SFT1 | SFT0 | Shift amount | Times of multiplication |
|---|---|---|---|
| 0 | 0 | 0 | × 1 |
| 0 | 1 | 1 bit to left | × 2 |
| 1 | 0 | 2 bits to left | × 4 |
| 1 | 1 | 3 bits to left | × 8 |

As described above, the shift data SFT1 and SFT0 are supplied in accordance with tone color or other factor. For example, in a tone color whose tone waveshape is relatively close to a square wave, the problem of noise is not so serious even if the level decreases and in this case the shift amount may be zero or a small amount. In a tone color whose tone waveshape is complex, the problem of noise is serious when the level is small so that the shift amount is increased to achieve more rapid attenuation.

The release rate data RR applied to the shift circuit 66 is for example 7 bits and its output is 10 bits. Rightmost 7 bits of this 10-bit output are provided as the rate data RR' through an OR gate group 67. Leftmost 3 bits of the 10-bit output are applied to an OR gate group 68 and, when the output of the OR gate group 68 is "1", all bits of the output data RR' of the OR gate group 67 becomes "1" (i.e., maximum value).

Figure 10:
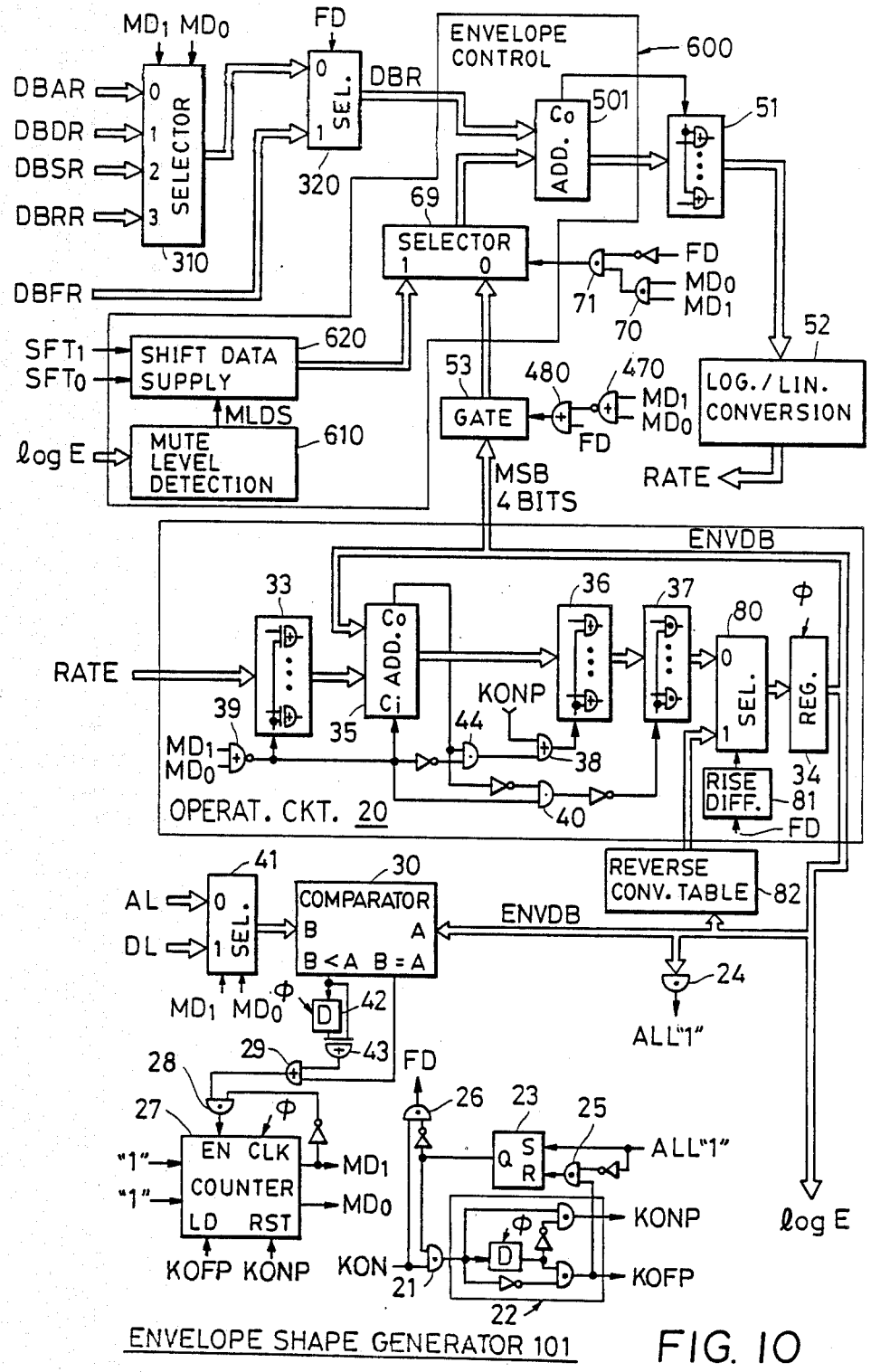
FIG. 10 is a block diagram showing another embodiment of the envelope shape generator according to the invention comprising the envelope control device.

FIG. 10 is another embodiment of the envelope shape generator 101. As the envelope shape generator 10 of FIG. 5, the envelope shape generator 101 provides rate data in decibel representation achieves determination of curves of the attack portion and the forcing damp portion at desired characteristics by changing the rate data supplied to the operation circuit 20 in accordance with the level of the envelope shape. In FIG. 10, the component parts designated by the same reference characters as in FIG. 5 perform the same functions so that detailed description thereof will be omitted.

Difference between the embodiment of FIG. 10 and that of FIG. 5 is that in the embodiment of FIG. 10, an envelope control device 600 is provided. In FIG. 5, the adder 50 is provided between a selector 320 and an OR gate group 51. In FIG. 10, this adder 50 is replaced by the envelope control device 600 incorporating a similar adder 501. The envelope control device 600 performs the mute control as does the envelope control device 60 of FIG. 7. As the embodiment of FIG. 5, the embodiment of FIG. 10 can enlarge dynamic range of rate data which is determined by a limited number of bits as shown by the above described Table 2 by determining rate data in decibel representation.

In the same manner as in FIG. 5, rate data DBR in decibel representation provided from a selector 320 (one of DBAR - DBFR selected by selectors 310 and 320) is supplied to a logarithm/linear conversion circuit 52 through an adder 501 and an OR gate group 51. The rate data is converted to rate data in linear representation (RATE) by the conversion circuit 52 and thereafter is applied to an inversion control circuit 33 of the operation circuit 20.

The adder 501, OR gate group 51 and gate 53 are provided for performing functions similar to those of the curve conversion table 45 in FIG. 7 (i.e., forming the envelope shape data in the attack portion with a characteristic whose inclination of rising is steep at the beginning and becomes relatively gradual thereafter as shown in FIGS. 3*b* and 8*b* and forming the envelope shape data in the forcing damp portion with a characteristic whose inclination of attenuation is relatively gradual at the beginning and becomes increasingly steeper thereafter as shown in FIG. 3*b*).

The envelope control device 600 comprises a mute level detection circuit 610, a shift data supply circuit 620 and the above described adder 501 and performs functions similar to those of the envelope control device 60. The adder 501 is used both for converting rate data for the mute control and converting rate data for the forcing damp. The mute level detection circuit 610 is of a similar construction as the mute level detection circuit 61 and produces a mute level detection circuit MLDS when the level of the envelope shape data log E drops below the mute level ML. The shift data supply circuit 620 supplies, upon detection by the detection circuit 610 of the fact that the level of the envelope shape data log E has dropped below the mute level, the above described shift data SFT1 and SFT0 to "1" input of a selector 69. To "0" input of the selector 69 is applied the output of the gate 53. Mode signals MD1 and MD0 are supplied to an AND gate 70 and this signal and an inverted signal of the forcing damp signal FD are applied to an AND gate 71. The output of the AND gate 71 in turn is applied to a control input of the selector 69. If there is no forcing damp during the release mode, the output of the AND gate 71 is turned to "1" whereby the shift data SFT1 and SFT0 from the shift data circuit 620 are selected by the selector 69 and applied to the adder 501. On the other hand, during the attack mode and the forcing damp mode, the output of the gate 53 is selected by the selector 69 and applied to the adder 501.

The adder 501 adds the rate data DBR in decibel representation provided from the selector 320 and the data selected by the selector 69 together. More specifically, the adder 501 adds, during the attack mode and forcing damp mode, leftmost 4-bit data of envelope shape data ENVDB provided from the gate 53 and the rate data DBR together whereas during the mute control, the adder 501 adds the shift data SFT1 and SFT0 selected by the selector 69 to the release rate data DBRR. The output of the adder 501 is applied to the logarithm/linear conversion circuit 52 through the OR gate group 51.

In modes other than the attack mode and forcing damp mode, i.e., in the decay, sustain and release modes, the output of the OR gate 480 is "0" and the gate 53 is closed so that data supplied from the gate 53 to one input of the adder 501 is all "0" and the rate data DBR in decibel representation provided from the selector 320 is applied directly to the logarithm/linear conversion circuit 52. During the mute control, however, the shift data SFT1 and SFT0 are selected by the selector 69 and applied to the adder 501 and added therein to the release rate data DBRR in decibel representation provided from the selector 320.

In the attack mode or the forcing damp mode, the output of the OR gate 480 is "1" and, as described above, the gate 53 is opened and leftmost 4-bit data of the envelope shape data ENVDB is supplied to one input of the adder 501 through the gate 53 and the selector 69.

Figure 11:
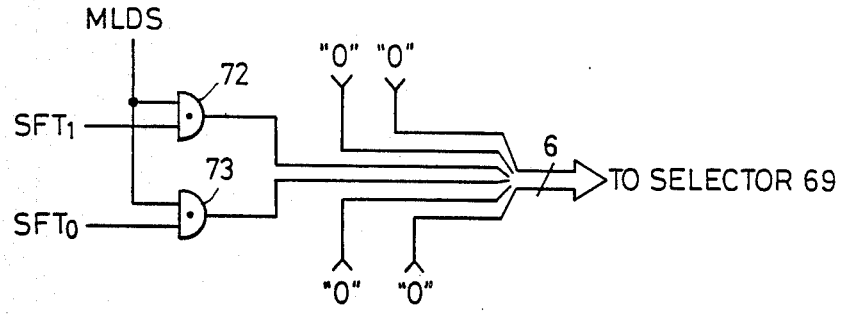
FIG. 11 is a block diagram showing a specific example of a shift data supply circuit in FIG. 10.
Figure 12A:
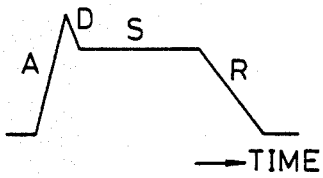
FIGS. 12*a* through 12*c* are diagrams showing examples of forming of an envelope shape in the prior art device.
Figure 12B:
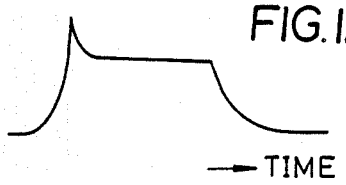
Figure 12C:
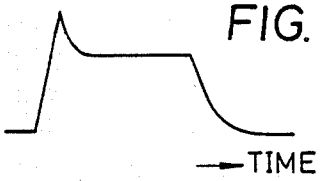
FIG. 12c (PRIOR ART)
Figure 13A:
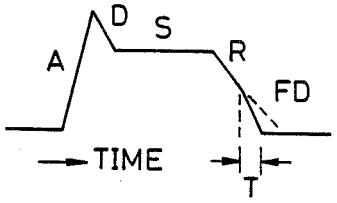
FIGS. 13*a* and 13*b* are diagrams showing examples of forming of an envelope shape in the prior art device when forcing damp is to be performed.
Figure 13B:
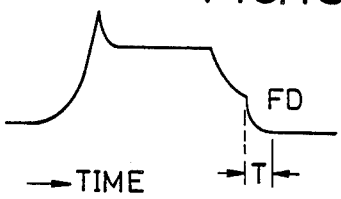
FIG. 13b (PRIOR ART)
Figure 14A:
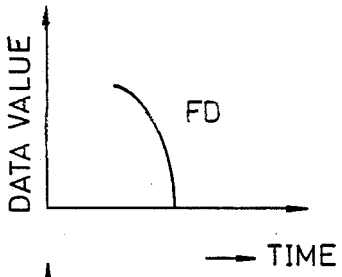
FIGS. 14*a* and 14*b* are diagrams showing examples of forming of an envelope shape according to the invention when forcing damp is to be performed.
Figure 14B:
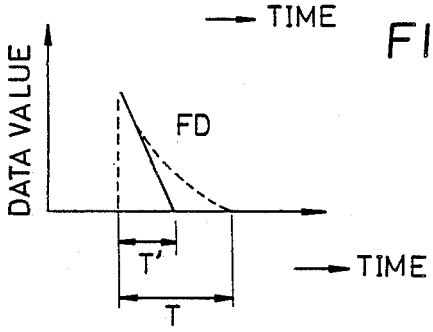
Figure 15A:
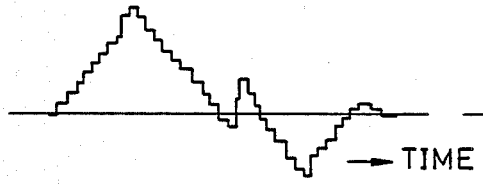
FIGS. 15*a* and 15*b* are waveshape diagrams showing the problem in the prior art in the release control of a tone signal.
Figure 15B:
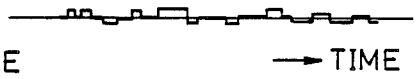
Figure 16:
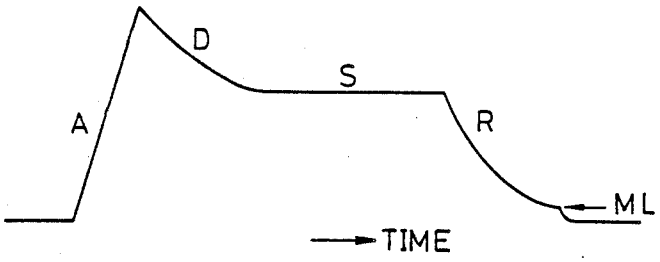
FIG. 16 is a diagram showing an example of an envelope shape for which a mute control according to the invention has been performed in the release portion.

FIG. 11 shows a specific example of the shift data supply circuit 620. In the shift data supply circuit 620, the shift data SFT1 and SFT0 are applied to AND gates 72 and 73 and gated out when the mute level detection signal MLDS from the mute level detection circuit 610 is "1". At this time, 2 bits each of "0" are added to the leftmost and rightmost bits of the shift data SFT1 and SFT0 so that the shift data SFT1 and SFT0 are provided as 6-bit data. As described previously, the release rate data DBRR is data of 6 bits and weighting of respective bits in adding the two data in the adder 501 is as shown in the following Table 6:

TABLE 6

| | MSB | | | | | LSB |
|---|---|---|---|---|---|---|
| Bit | 6 | 5 | 4 | 3 | 2 | 1 |
| Weight of DBRR | 48 | 24 | 12 | 6 | 3 | dB 1.5 |
| Weight of SFT0 | | | | 6 dB | | |
| Weight of SFT1 | | | | 12 dB | | |

In the arithmetic operation in this adder 501, the shift data SFT1 and SFT0 function to increse value of the rate data RATE in linear representation corresponding to the release rade data DBRR by 2 fold as shown in Table 2. If the shift data SFT1 and SFT0 are data in decibel representation, rate data RATE in linear representation obtained by adding the value n of the shift data SFT1 and SFT0 (n being a decimal number and n=1 corresponding to 6 dB) to the release rate data DBRR in decibel representation and converting result of this addition by the logarithm/linear conversion circuit 52 is 2 fold of the value in linear representation corresponding to the original rate data DBRR. Accordingly, as in the previously described embodiment, the envelope shape data can be attenuated rapidly as in the portion R′ in FIG. 8*b* by enlarging the value of the rate data during the mute control.

The embodiment of FIG. 10 has the same various advantages as described with respect to the embodiment of FIG. 5.

The mute level detection circuits 61 and 610 of FIGS. 7 and 10 detect the level of the output envelope shape data log E of the envelope shape generator 101. These circuits may detect the level of the envelope shape on the basis of the level of some other equivalent signal (e.g., the output envelope shape data ENVDB of the operation circuit 20).

In the embodiments of FIGS. 7 and 10, the envelope shape generator 101 generates the envelope shape data log E in decibel representation. Alternatively, the envelope shape generator 101 may generate envelope shape data in linear representation. Further, the system for forming the envelope shape in the envelope shape generator 101 need not be the arithmetic operation system as employed in these embodiments but it may be other suitable system such as the memory system.

Application of the envelope generator according to the invention concerning the mute control function is not limited to the envelope shape generator for determining tone volume amplitude but it is applicable broadly to similar cases where noise is produced due to scarcity of bit number of digital data controlled by an envelope shape.

In sum, according to the invention, if an envelope shape should be attenuated rapidly, envelope shape data in decibel representation formed by the envelope shape forming means is attenuated rapidly with a characteristic according to which inclination of attenuation becomes increasingly steeper and, accordingly, in converting this envelops shape data to data in linear representatin in a subsequent stage, the data can be attenuated rapidly with the steep inclination being maintained over substantially entire range of the rapidly attenuating portion. Consequently, even if inclination at the beginning of the rapidly attenuating portion is one to the extent that a click sound is not generated, time of the rapidly attenuating portion can be shortened and a next envelope shape can be caused to rise rapidly as compared with the rapidly attenuating portion in the prior art device by maintaining this inclination substantially to the end. Therefore, in a case where the present invention has been applied to generation of the tone volume amplitude envelope shape, sounding of a next tone can be made rapidly without delaying it. In a case where the present invention has been applied to generation of the envelope shape for controlling of tone color, the envelope shape for controlling a next tone can be caused to rise rapidly without delaying it so that sounding of a next tone can be started without delay.

Further, according to the invention, when the level of an envelope shape signal has dropped below a certain level corresponding to the minimum level at which a tone waveshape can be effectively represented during attenuation of the envelope shape signal, the envelope shape signal is caused to attenuate rapidly so that a portion of the envelope shape signal of such a small level that a tone waveshape cannot be effectively represented is attenuated rapidly and a tone corresponding to this portion is rapidly erased (i.e., muted) so that unpleasant noise can be restrained.

What is claimed is:

1. An envelope shape generator having a rapid attenuation capability comprising:

envelope shape forming means for forming envelope shape data for controlling a tone signal in the form of data in decibel representation; and rapid attenuation means operative within a rapid attenuation period during which rapid attenuation is desired for rapidly attenuation the envelope shape data in decibel representation with such a characteristic that inclination of attenuation becomes increasingly steeper to achieve rapid attenuation.

2. An envelope shape generator as defined in claim 1, wherein said rapid attenuation means comprises a first table defining a curve having a varying inclination which receives as input data the envelope shape data formed by said envelope shape forming means and converts the value of the input data to output data such that the inclination of attenuation becomes increasingly steeper.

3. An envelope shape generator as defined in claim 2 wherein said table performs the conversion with a logarithmic conversion characteristic according to which the inclination becomes steeper as the amount of attenuation represented by the input envelope shape data increases and becomes more gradual as the amount of attenuation decreases.

4. An envelope shape generator as defined in claim 2 which further comprises a reverse conversion table defining a curve having a varying inclination which is reverse to the conversion characteristic of said first table and in which the value of the envelope shape data immediately before the rapid attenuation is converted by this reverse conversion table, the converted data is applied to said first table of said rapid attenuation means and is used as the value of the envelope shape data at the beginning of the rapid attenuation whereby the values of the envelope shape data immediately before the rapid attenuation and at the beginning of the rapid attenuation are smoothly connected together.

5. An envelope shape generator as defined in claim further comprising means for connecting a value of the envelope shape data immediately before the rapid attenuation to minimize discontinuity in the envelope shape.

6. An envelope shape generator as defined in claim 5 wherein said means for connecting the two values uses, as the value of the envelope shape data at the beginning of the rapid attenuation, a value which is the same as the value of the envelope shape data immediately before the rapid attenuation.

7. An envelope shape generator as defined in claim 1 wherein said envelope shape generation means performs an arithmetic operation by repetitively adding or subtracting numerical data to form an envelope shape data having an inclination determined by the rate of this arithmetic operation and said rapid attenuation means changes the rate of the arithmetic operation in said envelope shape forming means with a lapse of time when the envelope shape should be rapidly attenuated so that the inclination of attenuation of the envelope shape data formed by said envelope shape forming means becomes increasingly steeper.

8. An envelope shape generator as defined in claim 7 wherein the change of the arithmetic operation rate by said rapid attenuation means is made in accordance with present value of the envelope shape data formed by said envelope shape forming means.

9. An envelope shape generator as defined in claim 1 wherein said envelope shape forming means comprises means for providing rate data representing inclination of the envelope shape in decibel representation and operation means for forming the envelope shape data having said inclination by repetitively adding or subtracting rate data in linear representation, and said rapid attenuation means performs an operation for gradually changing the rate data in decibel representation when the envelope shape should be rapidly attenuated.

10. An envelope shape generator as defined in claim 1 further comprising linear conversion means for converting envelope shape data in decibel representation having a rapid attenuation characteristic in which inclination of attenuation becomes increasingly steeper or data scaled by this envelope shape data to data in linear representation and causing a rapidly attenuation portion in the envelope shape of the converted data in linear representation to have substantially uniform inclination.

11. An envelope shape generator comprising:

envelope shape forming means for forming envelope shape data for controlling a tone signal;

detection means for detecting that the level of the envelope shape data or the level of an envelope shape signal generated on the basis of this data has dropped below a predetermined level corresponding to a minimum level at which a tone waveshape can be effectively represented; and rapid attenuation control means for rapidly attenuation the envelope shape data formed by said envelope shape forming means in response to the detection by said detection means.

12. In an envelope generator for providing logarithmic envelope attenuation data representative of the attack, decay, sustain and release portions of an envelope to an electronic musical instrument capable of outputting desired sounds, and wherein the envelope generator is capable of providing a forced damp in response to certain predetermined events, the improvement comprising:

an output;

means for storing a current value;

means for replacing the current stored value with the current value plus a second value;

forced damp detecting means for determining the occurrence of one of the predetermined events;

a first conversion means for producing, in response to the current stored value as an input, an output value according to a first function, wherein the function has an increasingly negative slope;

selection means responsive to the forced damp detecting means for selectively furnishing the current stored value at the output before the occurrence of one of events during the release portion and for selectively furnishing the output value produced by the first conversion means after one of the events during the release portion.

13. The envelope generator of claim 12, wherein the selection means includes means for furnishing at the output the second value during the attack portion of the envelope.

14. The envelope generator of claim 12, wherein the envelope generator further includes:

second conversion means operative in response to the forced damp detecting means for replacing the current stored value with a third value according to a second function, wherein the second function is the inverse function of the first function.

15. The envelope generator of claim 14, wherein the first function supplies as the second value the logarithm of the current value and the second function replaces the current value with the antilogarithm of the current value.

16. The envelope generator of claim 12, wherein the first function supplies as the output value the logarithm of the current value.

17. The envelope generator of claim 12, wherein the envelope generator is adapted for use in a digital electronic musical instrument producing an output sound that contains quantization noise and the envelope generator further includes:

noise averting means for detecting when the output of the envelope generator will cause sufficient attenuation that the ratio of desired output sound signal of the instrument to the quantization noise is less than a predetermined limit; and means for rapidly attenuating the envelope in response to the noise averting means.

18. The envelope generator of claim 17, wherein the means for rapidly attenuating comprises:

means for modifying the second value before adding the second value to the current value.

19. An envelope generator for generating the attack, decay, sustain and release and forced damp portions of an envelope for musical tones, the envelope generator comprising:

an output at which the envelope is represented in attenuation data in decibels and the generated envelope has a second derivative;

a memory means for storing a current value representing the envelope during at least the decay and the sustain portions of the envelope;

means for detecting when the envelope should be forced damped; and processing means for mathematically altering and replacing the current value with a new value and for providing to the output a series of values defining the envelope, such that the second derivative of the envelope is negative for at least part of the time while forced damping occurs and the second derivative never exceeds zero while forced damping occurs.

20. The envelope generator of claim 19, wherein the current value represents the envelope during all stages of the envelope.

21. The envelope generator of claim 19, wherein the processing means includes rapid attenuation means for rapidly attenuating the envelope shape data in decibel representation with such a characteristic that inclination of attenuation becomes increasingly steeper when the envelope is being forced damped.

22. The envelope generator of claim 21, wherein the processing means includes a conversion means defining a mathematical function producing an output value in response to an input value and having a first derivative that is negative and a second derivative that never exceeds zero and is negative for at least some of the output values; and wherein the processing means generates the output values during the forced damp portion by using the current value as the input value.

23. The envelope generator of claim 21, wherein the processing means includes means for supplying a second value to be added to the current value during the forced damped portion of the envelope and means for multiplying the second value by a series of ever increasing values as the attenuation of the envelope increases.

24. In an envelope generator for generating the attack, decay, sustain and release attenuation data of an envelope, and wherein the envelope generator is adapted for changing the attenuation of at least two rates digitally generated musical tone signals, the improvement comprising:

detector means for detecting that the signal to noise ratio of the tone signal tot he quantization noise has fallen below a predetermined level while generating the release attenuation data; and means responsive to the detector means for increasing the rate of attenuation to thereby reduce the portion of time that the signal to noise ratio has fallen below the predetermined level.

25. In the envelope generator of claim 24, the attenuation detector means comprising:

means for detecting while generating the release attenuation data that the level of attenuation has exceeded a predefined limit.

* * * * *